US008418632B2

(12) United States Patent
Linares

(10) Patent No.: US 8,418,632 B2
(45) Date of Patent: Apr. 16, 2013

(54) PALLET ASSEMBLY WITH LOCATING SUPPORT STRUCTURE

(75) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 26 days.

(21) Appl. No.: 13/081,953

(22) Filed: Apr. 7, 2011

(65) Prior Publication Data

US 2011/0179977 A1 Jul. 28, 2011

Related U.S. Application Data

(63) Continuation-in-part of application No. 12/608,512, filed on Oct. 29, 2009, now Pat. No. 8,146,516, which is a continuation-in-part of application No. 12/414,017, filed on Mar. 30, 2009, now Pat. No. 8,196,527, and a continuation-in-part of application No. 12/467,601, filed on May 18, 2009, now abandoned, and a continuation-in-part of application No. 12/414,017.

(60) Provisional application No. 61/074,306, filed on Jun. 20, 2008, provisional application No. 61/328,682, filed on Apr. 28, 2010.

(51) Int. Cl.
*B65D 19/44* (2006.01)

(52) U.S. Cl.
USPC ..... 108/55.1; 108/57.25; 108/51.3; 108/53.1

(58) Field of Classification Search ..... 108/55.3, 108/55.1, 55.5, 51.11, 57.25, 51.3; 248/346.02; 206/386, 595, 596, 597, 598
See application file for complete search history.

(56) References Cited

U.S. PATENT DOCUMENTS

| | | | | |
|---|---|---|---|---|
| 2,477,852 | A | 8/1949 | Bacon | |
| 2,709,559 | A | 5/1955 | Geisler | |
| 2,913,206 | A | 11/1959 | Paris | |
| 2,914,282 | A | 11/1959 | Budd | |
| 3,556,886 | A * | 1/1971 | Reusser | 108/51.3 |
| 3,568,912 | A | 3/1971 | de Simas | |
| 3,580,190 | A | 5/1971 | Fowler | |
| 3,587,479 | A | 6/1971 | Geschwender | |
| 3,664,272 | A | 5/1972 | Sanders | |
| 3,675,595 | A | 7/1972 | Sullivan | |

(Continued)

FOREIGN PATENT DOCUMENTS

| | | | |
|---|---|---|---|
| JP | 02139341 | A | 5/1990 |
| JP | 03029744 | A | 2/1991 |

(Continued)

*Primary Examiner* — Jose V Chen
(74) *Attorney, Agent, or Firm* — Gifford, Krass, Sprinkle, Anderson & Citkowski, P.C.; Douglas J. McEvoy

(57) ABSTRACT

A structurally reinforcing pallet having an insert exhibiting a three dimensional shape with a top, sides and bottom. A plasticized material is applied over the insert according to a selected thickness and in order to encapsulate the insert. A first plurality of upper edge projecting and positional locating rim portions are exhibited about a periphery of an insert incorporated into a first pallet and, in combination with a second mating plurality of recessed underside edge extending locations exhibited about a periphery of a further insert incorporated into a second pallet, enable multiple stacking of pallets in laterally stabilized fashion.

14 Claims, 12 Drawing Sheets

U.S. PATENT DOCUMENTS 3,710,733 A 1/1973 Story
3,719,157 A 3/1973 Arcocha et al.
3,720,176 A 3/1973 Munroe
3,814,778 A 6/1974 Hosoda et al.
3,832,955 A 9/1974 Pottinger et al.
3,955,613 A 5/1976 Lund
3,982,057 A 9/1976 Briggs et al.
4,008,669 A * 2/1977 Sumrell ..... 410/47
4,220,100 A 9/1980 Palomo et al.
4,507,348 A 3/1985 Nagata et al.
4,597,338 A 7/1986 Kreeger
4,715,294 A 12/1987 Depew
4,829,909 A 5/1989 Mandel
4,843,976 A 7/1989 Pigott et al.
4,931,340 A 6/1990 Baba et al.
5,076,176 A 12/1991 Clasen
5,082,712 A 1/1992 Starp
5,143,778 A 9/1992 Shuert
5,205,221 A 4/1993 Melin et al.
5,320,048 A 6/1994 Feiner
5,365,858 A 11/1994 Kuhns
5,401,456 A 3/1995 Alesi, Jr. et al.
5,423,428 A 6/1995 Selz
5,473,995 A 12/1995 Gottlieb
5,476,048 A 12/1995 Yamashita et al.
5,551,353 A 9/1996 Fiedler
5,579,686 A 12/1996 Pigott et al.
5,605,102 A 2/1997 Simpson
5,687,652 A 11/1997 Ruma
5,709,913 A 1/1998 Andersen et al.
5,772,369 A * 6/1998 Lerman et al. ..... 108/55.5
5,868,080 A 2/1999 Wyler et al.
5,890,437 A 4/1999 Hill
6,209,464 B1 4/2001 Elder
6,294,114 B1 9/2001 Muirhead
6,357,364 B1 3/2002 Maloney et al.
6,357,366 B1 3/2002 Frankenberg
6,524,040 B1 * 2/2003 Heil ..... 410/67
6,524,426 B1 2/2003 St. John et al.
6,530,330 B2 3/2003 Sepe et al.
6,569,509 B1 5/2003 Alts
6,598,541 B2 7/2003 Vilkki
6,655,299 B2 12/2003 Preisler et al.
6,705,237 B2 3/2004 Moore, Jr. et al.
6,725,783 B2 * 4/2004 Sekino ..... 108/55.3
6,745,703 B2 6/2004 Torrey et al.
6,863,003 B2 3/2005 Grainger
6,938,559 B2 9/2005 Wullenweber
6,954,982 B2 10/2005 Isle et al.
6,972,144 B2 12/2005 Roth et al.
6,976,437 B2 12/2005 Fisch et al.
6,983,704 B1 * 1/2006 Ness ..... 108/55.3
7,013,814 B2 3/2006 Modesitt et al.
7,143,564 B2 12/2006 Renck
7,197,989 B2 4/2007 Apps
7,469,643 B2 12/2008 Isle et al.
7,726,248 B2 6/2010 Shuert
7,804,400 B2 9/2010 Muirhead
7,819,068 B2 10/2010 Apps et al.
8,146,516 B2 * 4/2012 Linares ..... 108/57.25
2002/0007770 A1 1/2002 Vilkki
2002/0106483 A1 8/2002 Obeshaw
2002/0148393 A1 * 10/2002 Milles ..... 108/53.1
2003/0024443 A1 2/2003 Hoshi
2003/0041956 A1 3/2003 Pigott et al.
2003/0070594 A1 4/2003 Isle et al.
2003/0136315 A1 7/2003 Kim
2003/0189152 A1 10/2003 Elder et al.
2004/0007164 A1 1/2004 Herring et al.
2004/0187745 A1 9/2004 Rojas et al.
2005/0076816 A1 4/2005 Nakano
2005/0211139 A1 * 9/2005 Perrotta et al. ..... 108/57.25
2005/0241548 A1 11/2005 Muirhead
2006/0003044 A1 1/2006 DiNello et al.
2006/0075939 A1 4/2006 Shuert
2006/0130712 A1 6/2006 Wang
2006/0144301 A1 7/2006 Borggaard
2006/0201402 A1 9/2006 Moore et al.
2006/0288915 A1 12/2006 Kulbeth et al.
2007/0215014 A1 9/2007 Lee
2007/0283857 A1 12/2007 Dong
2008/0053596 A1 3/2008 Davies et al.
2008/0060561 A1 3/2008 Carrasco
2008/0098935 A1 5/2008 Roth et al.
2008/0103944 A1 * 5/2008 Hagemann et al. ..... 108/51.11
2008/0110377 A1 5/2008 Stevens
2008/0156234 A1 7/2008 van de Camp
2008/0196633 A1 8/2008 Ho
2008/0210140 A1 9/2008 Valentinsson
2010/0154685 A1 6/2010 Arinstein

FOREIGN PATENT DOCUMENTS

JP 06156493 A 6/1994
JP 06-235780 A 8/1994
JP 08034014 A 2/1996
JP 08034438 A 2/1996
JP 08336866 A 12/1996
JP 11079180 A 3/1999
JP 11221828 8/1999
JP 2001-328632 A 11/2001
JP 2002166940 A 6/2002
JP 2003011969 A 1/2003
JP 2003-034330 A 2/2003
JP 2003-267370 A 9/2003
JP 2004090988 A 3/2004
JP 2005104562 A 4/2005
JP 2006036315 A 2/2006
JP 2006036331 A 2/2006
JP 2006298403 A 11/2006
JP 2008023741 A 2/2008
JP 2008087839 A 4/2008
KR 20030034370 A 5/2003
KR 10-0577441 5/2006
KR 1020090117107 11/2009
WO 2006082595 A1 8/2006

* cited by examiner

PALLET ASSEMBLY WITH LOCATING SUPPORT STRUCTURE

CROSS-REFERENCE TO RELATED APPLICATIONS

This Application claims the benefit of U.S. Provisional Application No. 61/328,682 filed on Apr. 28, 2010. This Application is also a Continuation-in-part of application Ser. No. 12/608,512 filed on Oct. 29, 2009, which in turn is a Continuation-in-part of both application Ser. No. 12/414,017 filed Mar. 30, 2009 and application Ser. No. 12/467,601 filed May 18, 2009. Application Ser. No. 12/467,601 is a Continuation-in-part of application Ser. No. 12/414,017 filed on Mar. 30, 2009 and also claims the benefit of U.S. Provisional Application No. 61/074,306 filed on Jun. 20, 2008.

FIELD OF THE INVENTION

The present invention is generally directed to a structurally supporting pallet assembly providing a lightweight blank or spine over which is sprayed or otherwise applied a polymeric material. More specifically, the present invention discloses such a pallet assembly further including a load bearing and locating platen key engaged and supported with the surface of the pallet.

BACKGROUND OF THE INVENTION

Wooden pallet constructions are well known in the prior art. Problems associated with wooden pallets include degradation of material construction and load bearing capabilities, such also resulting from the pallets becoming wet (and excessively heavy) and degrading over time. Additional problems include the inability to maintain in stacked arrangement volumes of pallets during non-use periods as well as during transport between locations.

SUMMARY OF THE INVENTION

The present invention discloses an improved and structurally reinforcing pallet which overcomes many of the disadvantages of conventional wooden pallets. Specifically, the present invention provides a lightweight, environmentally resistant platform exhibiting the properties of durability, increased load bearing capabilities and secure and positionally retaining stackability during periods of non use storage and/or transport.

The pallet includes an insert exhibiting a three dimensional shape with a top, sides and bottom. A plasticized material is applied over the insert according to a selected thickness and in order to encapsulate the insert. A first plurality of upper edge projecting and positional locating rim portions are exhibited about a periphery of an insert incorporated into a first pallet and, in combination with a second mating plurality of recessed underside edge extending locations exhibited about a periphery of a further insert incorporated into a second pallet, enable multiple stacking of pallets in laterally stabilized fashion.

Additional features include a load bearing and locating platen which exhibits a generally flattened and planar shape with an underside keyed projection, the insert further including a keyed inner recess exhibiting a mating shape which receives said underside keyed projection for seating the platen upon the insert. Each of the platen and insert may be constructed of any of a durable plastic, composite polymeric or corrugated and coated material.

A plurality of clamps are arranged in encircling fashion around the keyed inner recess, the clamps being mounted within individual pockets in a surface projecting fashion such that, upon locating and seating the platen upon the upper surface of the pallet insert, the clamps are individually rotated such that distal extended edges associated with each clamp engages an extending edge location of the platen.

A plurality of part supporting template portions arrayed in partially exploded fashion above mating recessed and locating channels are configured into an upper surface of the pallet insert to establish a recessed interior for fixing in position a selected template portion. Straps with end secured buckles engage specified and surface exposed locations along the pallet for restraining the template portions and stacked parts.

The insert further includes a plurality of elongated and side by side stacked honeycombed core elements. The insert may further be constructed from any of a polyethylene terephthalate material, a corrugated plastic structure, or an aggregate material entrained within a composite plasticized material.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As illustrated throughout the various illustrations, the present invention again discloses a structurally supporting pallet assembly providing a lightweight insert (also termed a structurally supporting blank or spine) according to a variety of corrugated paperboard, corrugated plastic, P.E.T. foam, and other possible materials including galvanized steel and over which is sprayed or otherwise applied a polymeric material. As will be further described in reference to the numerous variants of the invention illustrated, the present invention discloses a number of pallet constructions for providing increased load bearing support to cargo items of varying configuration.

Figure 1:
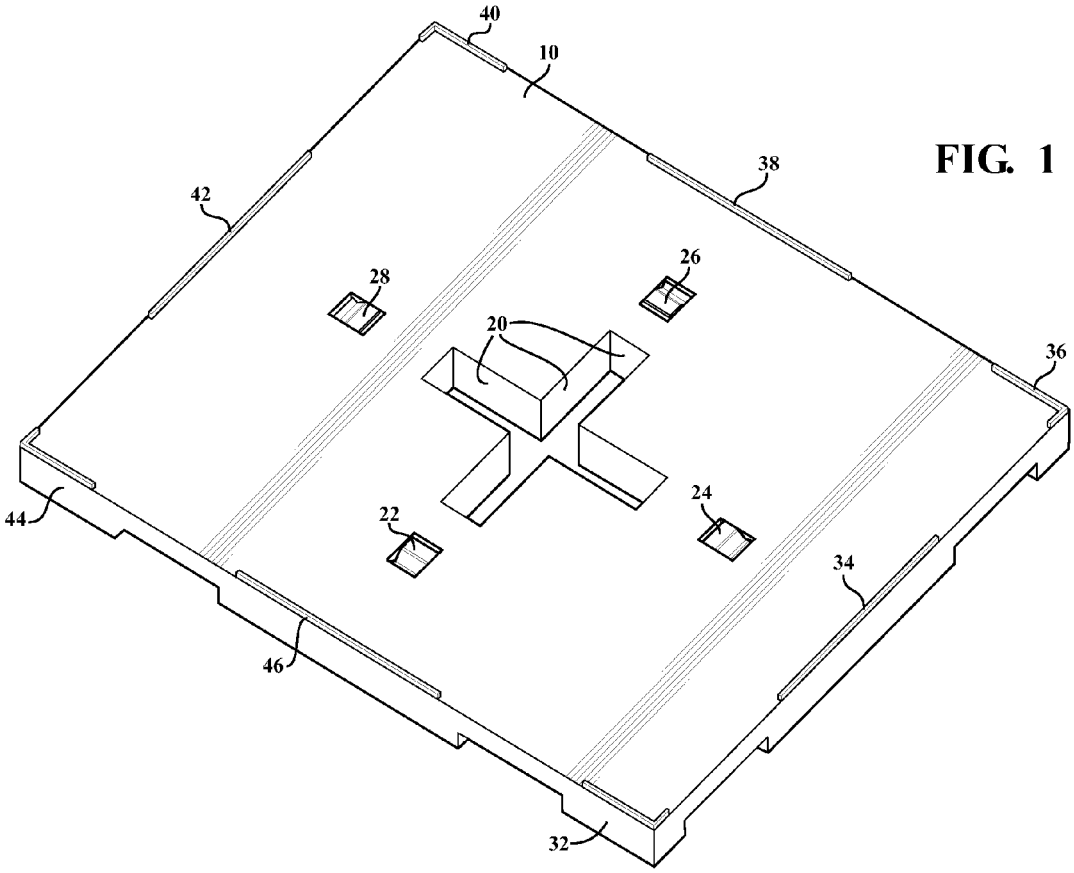
FIG. 1 is a perspective view of a structurally supporting pallet exhibiting a keyed and locating aperture in combination with a plurality of clamps encircling the locating aperture in mounted and surface projecting fashion.
Figure 2:
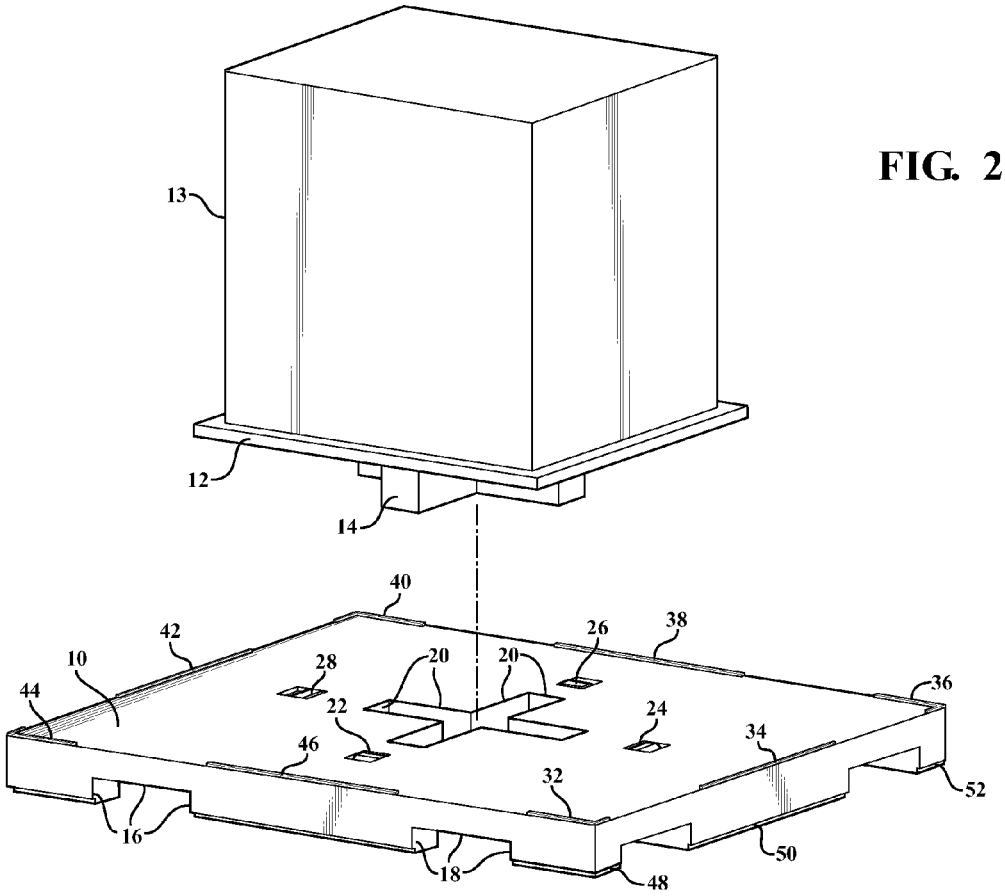
FIG. 2 is a succeeding view to that shown in FIG. 1 and further illustrating in partially exploded fashion a load supporting platen with underside projecting keyed configuration matching the pallet aperture for positionally locating and supporting the platen upon the pallet.
Figure 3:
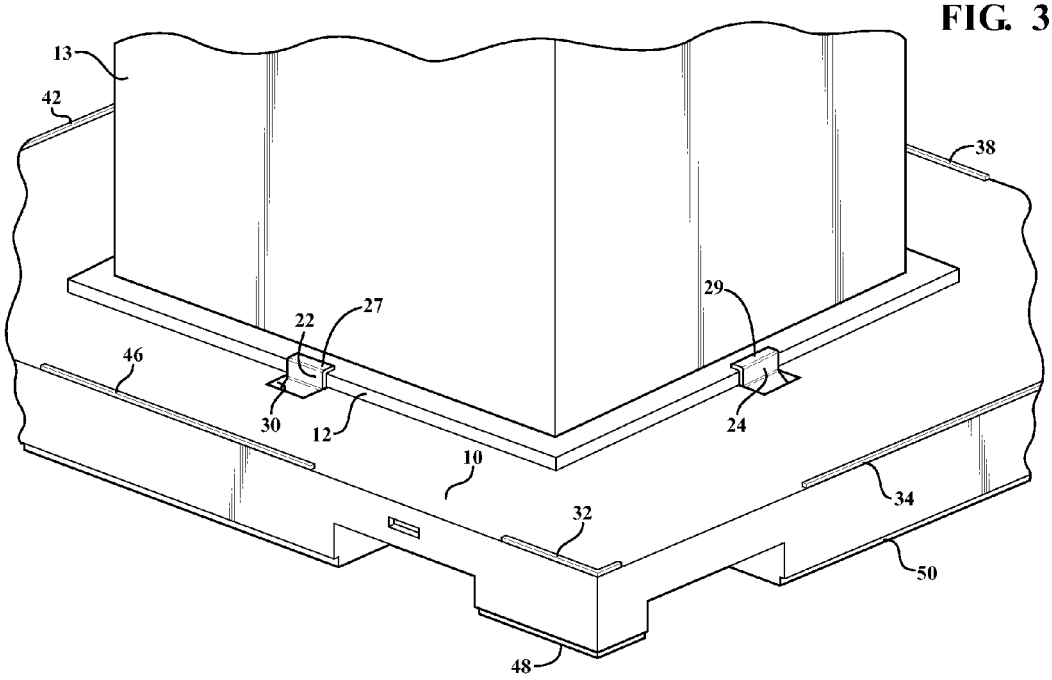
FIG. 3 is a further succeeding and enlarged perspective illustrating the assembly of the platen upon the pallet and with the clamps rotated into multiple edge engaging fashion with the platen, in combination with corner edge projecting and positional locating rim portions for enabling multiple stacking of pallets such as in a storage and/or transport configuration.

Additional to the construction of the pallet described throughout the several views, FIGS. 1-3 collectively disclose one application of a pallet assembly, generally shown by polymeric coated insert 10, which further includes a cargo load bearing and locating platen further depicted at 12 in FIGS. 2 and 3 and which exhibits a generally flattened and planar shape as well as an underside keyed (depicted as cross shaped) projecting configuration 14 (see as again shown in FIG. 2 with above-supported cargo 13). The platen 12 can include any of a durable plastic, composite polymeric or corrugated and coated material similar in respects to the underlying pallet.

The pallet 10 is constructed of a body which likewise exhibits a specified length, width and thickness including a flattened and upper rectangular and load supporting surface, combined with accessible side apertures (see interconnecting pluralities of underside edges at 16, 18, et seq. in FIG. 2) for receiving forklift load support rails (not shown). Additional features associated with the pallet 10 include a keyed inner recess (see plurality of interconnected walls 20 exhibiting a generally "+" shape which mates with and receives the underside projecting keyed shape 14 associated with the platen 12) for seating the platen 12 in a desired, typically centralized fashion, upon the pallet surface 10 as again depicted again in FIG. 3.

A plurality of clamps 22, 24, 26, and 28 are arranged at intermediate locations upon the pallet surface 10 in encircling fashion around the locating aperture 20. Each of the clamps are mounted within individually defined pockets (see as best representatively shown at 30 in FIG. 3 associated with selected rotating clamp 22) and such that the clamps can be rotated from recessed to surface projecting fashion.

As shown in FIG. 3, and upon locating and seating the platen 12 upon the upper surface of the pallet 10, the clamps 22-28 can be individually rotated such that distal extended edges associated with each clamp (see at 27 for clamp 22 and further at 29 for clamp 24) engage an extending edge location of the platen 12. Although not shown, it is further understood that a suitable locking structure can be incorporated into the body of the pallet for fixing each clamp (see again at 22) during its rotatable mounted relationship within a designated pocket (see again at 30) such that, and upon rotating the clamp to its engaging position of FIG. 3, the clamp is locked in place to prevent unseating (or lifting) of the keyed platen 12 from the surface of the pallet 10.

Also illustrated in each of FIGS. 1-3 are corner edge projecting and positional locating rim portions, illustrated at 32, 34, 36, 38, 40, 42, 44 and 46 in dedicated and spaced apart fashion around the upper edge periphery of the pallet 10. In combination with aligning/mating and recessed underside edge extending locations (see as best representatively shown at 48, 50 and 52 in alignment with top edge rims 32, 34 and 36) the mating rim and recess edge locations enable multiple stacking of pallets in laterally stabilized fashion as facilitated by the plurality of edge projecting and positional locating rim portions (see as depicted in FIG. 11 with pallets 10, 10', 10", et seq) during such as in a storage and/or transport configuration.

Figure 11:
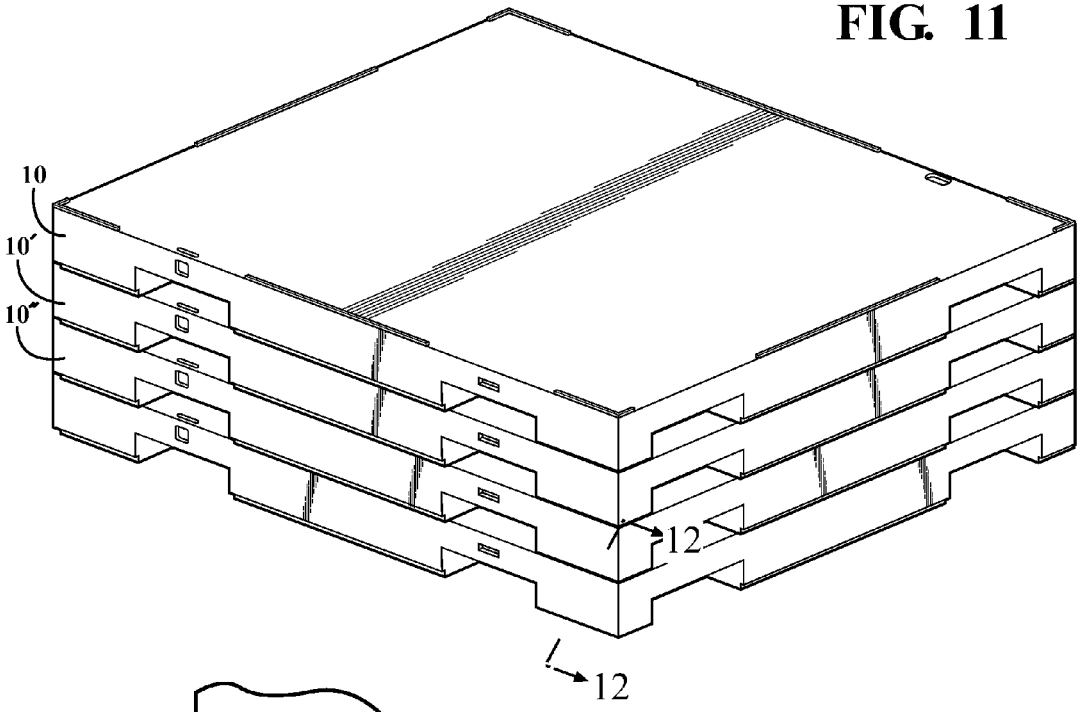
FIG. 11 is a perspective illustration of a plurality of pallets according to either of the variants of FIGS. 1 and 4 stacked in multiple and laterally stabilized fashion as facilitated by the plurality of edge projecting and positional locating rim portions.
Figure 12:
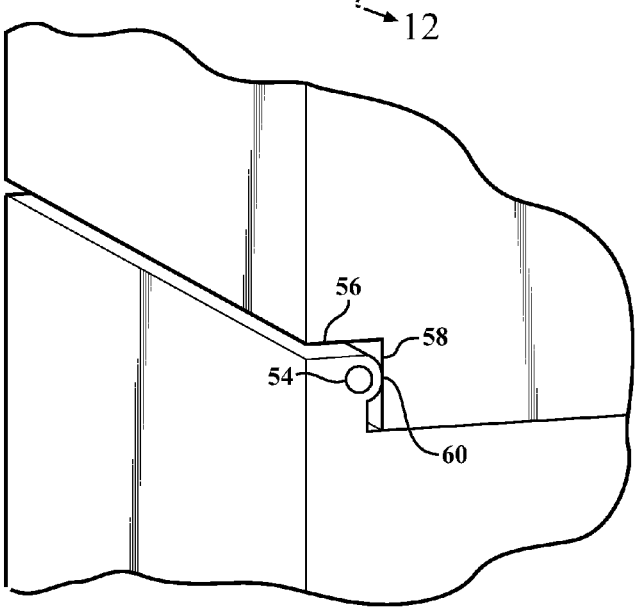
FIG. 12 is an enlarged view as depicted in FIG. 11 and illustrating one partial corner of an edge locating and seating arrangement configured between underside recesses and opposing and top edge projecting rim existing at each stacking location associated with succeeding pallets, as well as further depicting an inner arcuate surface associated with the top projecting rim for providing inward biasing and locating support between stacked pallets.

Referring further to FIG. 12, an enlarged view as depicted in FIG. 11 illustrates one partial corner of an edge locating and seating arrangement (illustrated by upper projecting and inwardly facing rim edge 54 in opposing engaged relationship with bottom outer edge recessed and interconnected angled sides 56 and 58), and which are configured at each stacking location as again represented in FIGS. 1-3 by upper spaced rim locations 32, 34, 36, 38, 40, 42, 44 and 46 associated with succeeding pallets. Of note, the upper edge projecting rim 54 depicts one desired configuration with an inner arcuate surface 60 (such as depicted by a bulbous inner projecting edge) and which creates a deflection point which seats or biases against selected side 58 of the underside perimeter recess in the succeeding stacked pallet and which collectively around the perimeter of each pallet stacking interface provides inward biasing and locating support between each stacked pallet. For purposes of clarity of illustration, each of FIGS. 12-14 illustrate a single edge at the designated corner interface (such as depicted by upper midpoint edge rims 34, 38, 42 and 46), it being understood that each of the upper corner rim edges 32, 36, 40 and 44 and associated underside corner recesses (again 48 and 52) can be formed in angled or "L" fashion as depicted.

Figure 13:
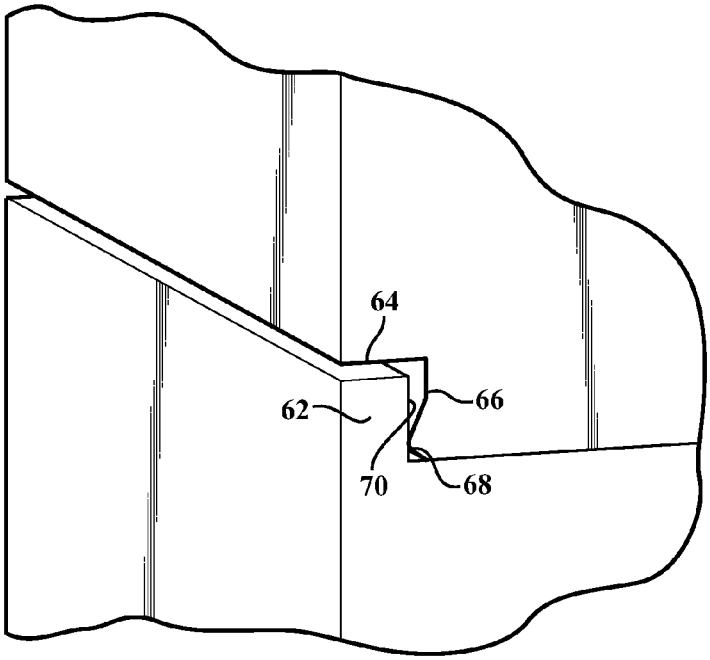
FIG. 13 is a similar illustration to FIG. 12 and further depicting a slightly modified rim and recess edge engaging configuration established at a corner location between successively stacked pallets.

FIG. 13 is a similar illustration to FIG. 12 and further depicting a slightly modified rim and recess edge engaging configuration (see projecting rim edge 62 which aligns with bottom recess defined by angled sides 64 and 66) again established at a corner location between successively stacked pallets. Also depicted is an outer angled edge 68 associated with side 66 and which seats within an opposing end face 70 of the upper projecting rim 62.

Figure 14:
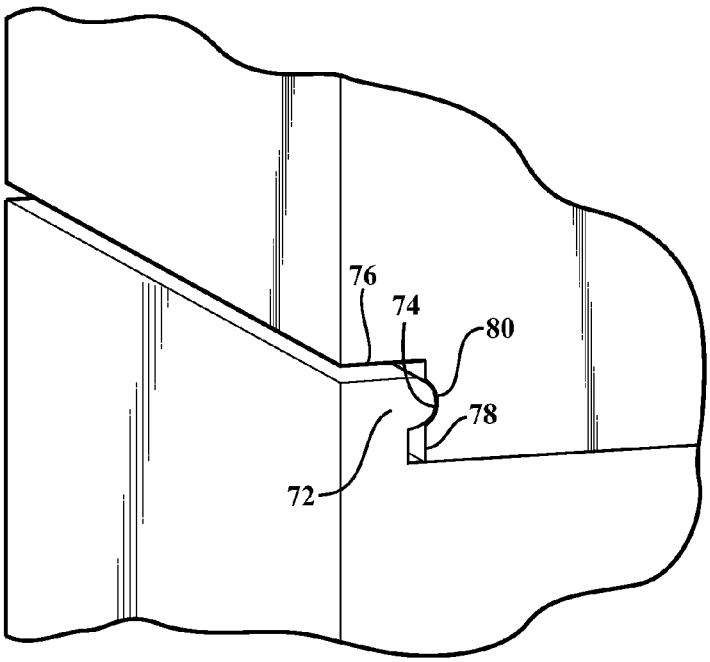
FIG. 14 is a yet further variant of rim/recess edge engaging configuration alternate to that illustrated in each of FIGS. 12 and 13.

FIG. 14 is a yet further variant of rim/recess edge engaging configuration, alternate to that illustrated in each of FIGS. 12 and 13, and depicting a further slightly modified rim and recess edge engaging configuration (see projecting rim edge 72 with bulbous projecting inner surface 74 which aligns with and biases against a bottom recessed edge defined by angled sides 76 and 78) likewise established at a corner location between successively stacked pallets. Also depicted is an inner arcuate contour 80 associated with angled 78 which receives and locates the bulbous contour 74 of the rim edge 72.

Figure 4:
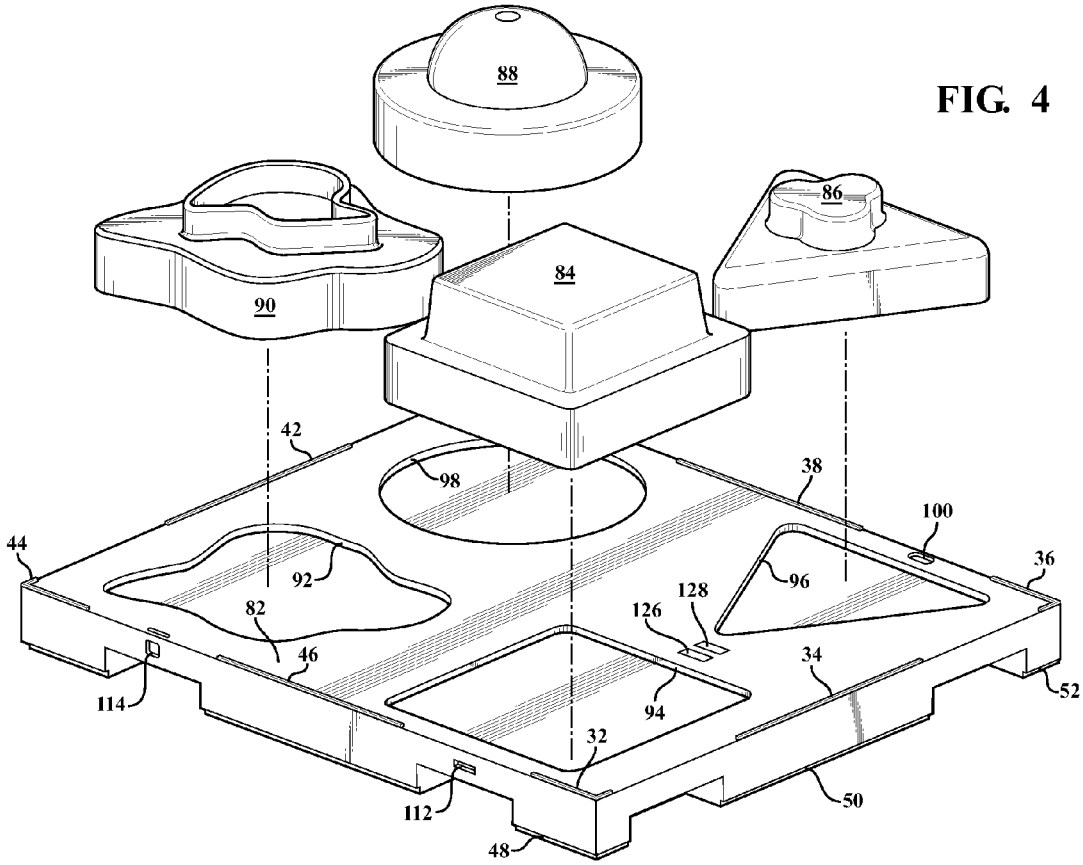
FIG. 4 is an illustration of a structurally supporting pallet according to a further embodiment and illustrating a plurality of part supporting template portions arrayed in partially exploded fashion above mating recessed and locating channels configured into a surface of the pallet.

Referring now to FIG. 4, an illustration is shown of a modified and structurally supporting pallet 82 which is similar in overall configuration and construction to that previously illustrated and described at 10 according to a further embodiment. As in FIG. 1, pluralities of upper rim edges 32, 34, 36, 38, 40, 42, 44 and 46 and lower recessed edges (again selectively shown at 48-52) are again shown and establish multiple stacking of the pallets in the manner depicted in FIG. 11.

Alternative to the platen 12 in the embodiment of FIGS. 1-3, also illustrated are a plurality of part supporting template portions, see at 84, 86, 88 and 90, which are arrayed in partially exploded fashion above mating recessed and locating channels, see as further respectively depicted by outlines 92, 94, 96 and 98, configured into the upper surface of the pallet to each establish a recessed interior for fixing in position a selected template portion.

Upon the template portions 84, 86, 88 and 90 being seated within their associated channel outlines, additional pluralities of individual parts (not shown) are provided and are capable of being stacked in plural supported fashion upon each template portion which in effect defines a mini platen like support for a given stack of parts. In this fashion, such parts can include recessed undersides for establishing multiple stackability, and further such that each part exhibits a recess interior profile matching each of those associated with the upper surfaces of each template portion 84, 86, 88 and 90.

A number of variations of straps (including fixed length, adjustable and/or flexible/bungee variety) with end secured buckles are provided for engaging specified locations along the pallet 82 and for restraining the specified template portions 84, 86, 88 and 90 (as well as individual pluralities of specifically configured parts not shown and which are supported in recess stacked fashion upon each template portion) in seated position upon the pallet 82. The straps and associated buckles engage locations formed in the pallet 82 at proximate locations associated with each template locating channel.

Figure 5:
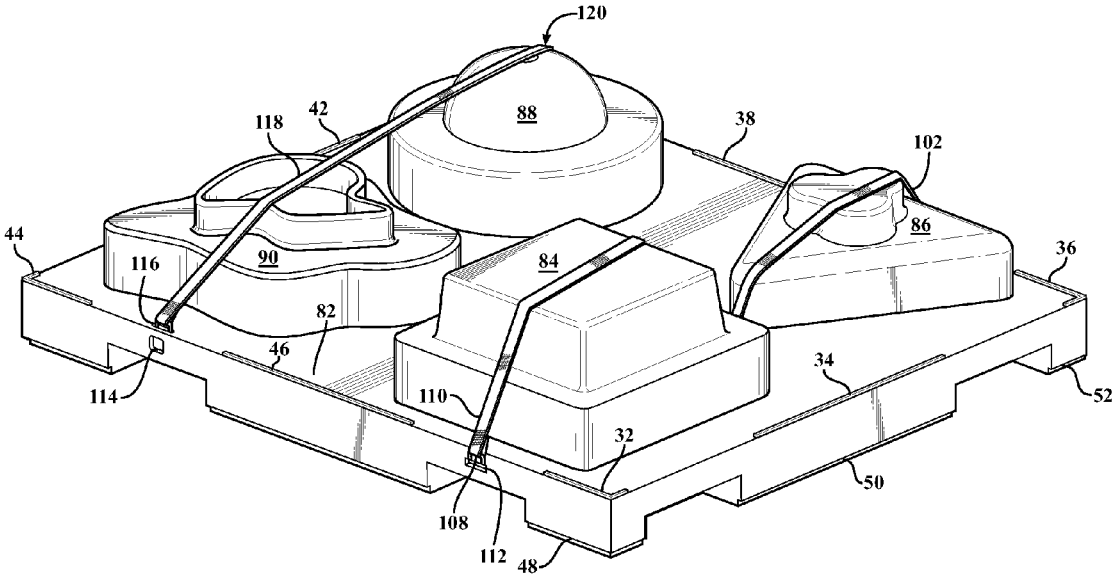
FIG. 5 is a succeeding illustration to FIG. 4 and illustrating the assembly of the template support portions in locating fashion upon the pallet, combined with attachable and adjustable locating straps configured for engaging locations formed in the pallet at proximate locations associated with each template locating channel.
Figure 6:
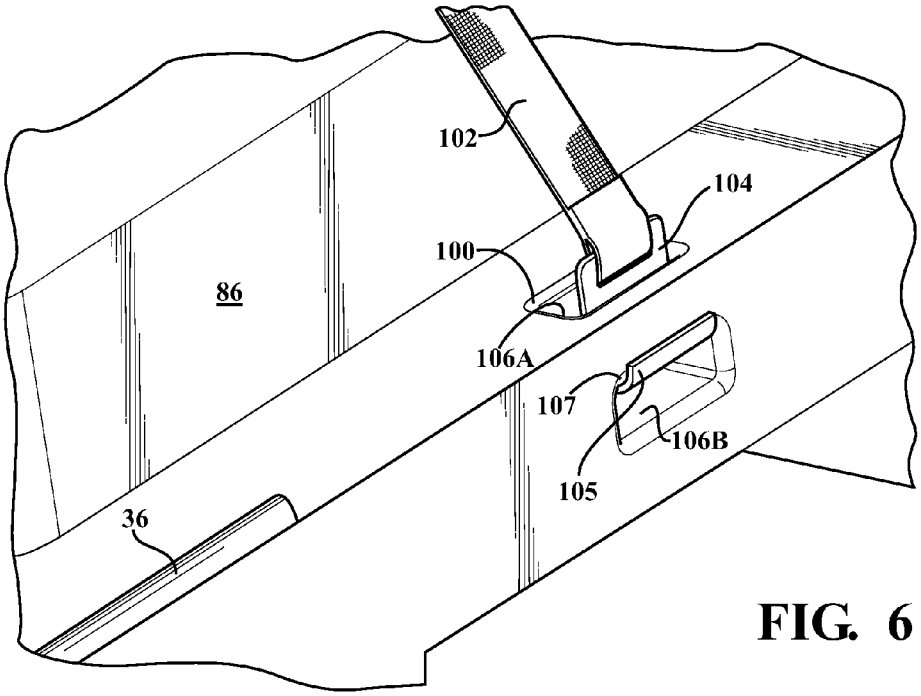
FIG. 6 is a further enlarged and rotated illustration of the pallet in FIG. 5 and further showing the configuration of the strap with end attached buckles engaged with configured locations formed in the pallet.

FIG. 6 is an enlarged and rotated illustration of the pallet in FIG. 5 and further showing the configuration of an end configured seating pocket (see inner perimeter defining walls 100) located in edge extending proximity to the selected channel outline 96 shown in FIG. 4. A first selected strap 102 includes an end attached buckle 104 with curled outer edge 105 which is inserted through a first and top accessible location 106A of the pocket 100 and engaged against an upper edge 107 of a communicating side accessible perimeter wall associated with an angularly communicated and side exposed location 106B of the pocket.

Figure 7:
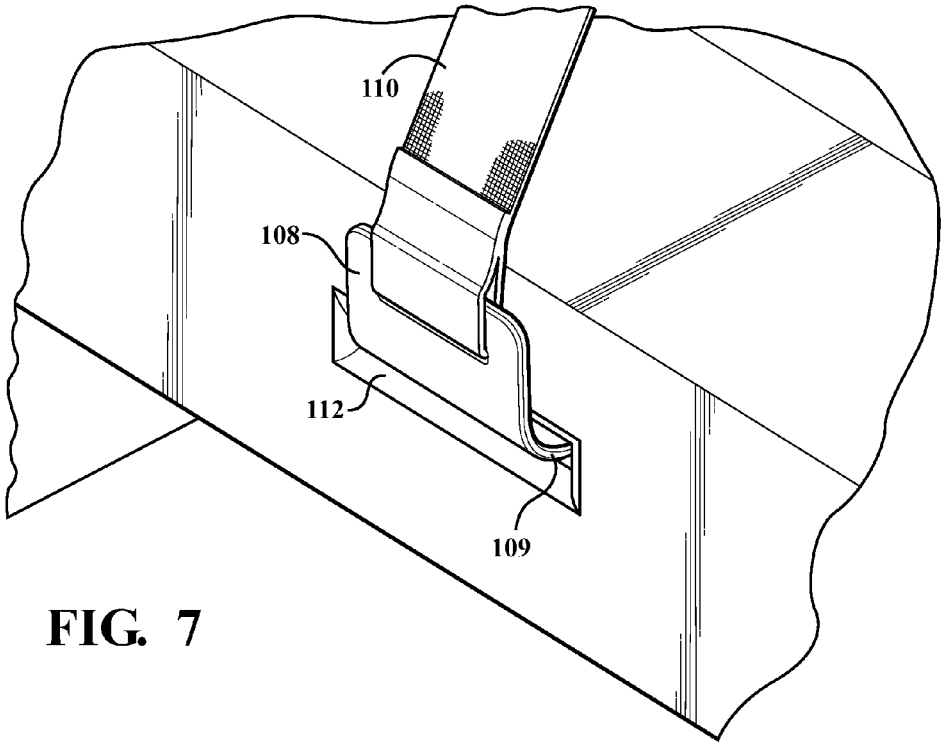
FIG. 7 is another enlarged view of a further configured end buckle associated with the pallet of FIG. 5.

FIG. 7 is another enlarged view of a further configured end buckle 108 connected to an edge of a second strap 110 associated with the pallet of FIG. 5. The buckle 108 includes a profile similar to that associated with buckle 104 and again includes a curled edge 109 which engages an upper edge of a further pocket 112 exhibited in a side of the pallet 82 approximate selected template portion 84.

Figure 8:
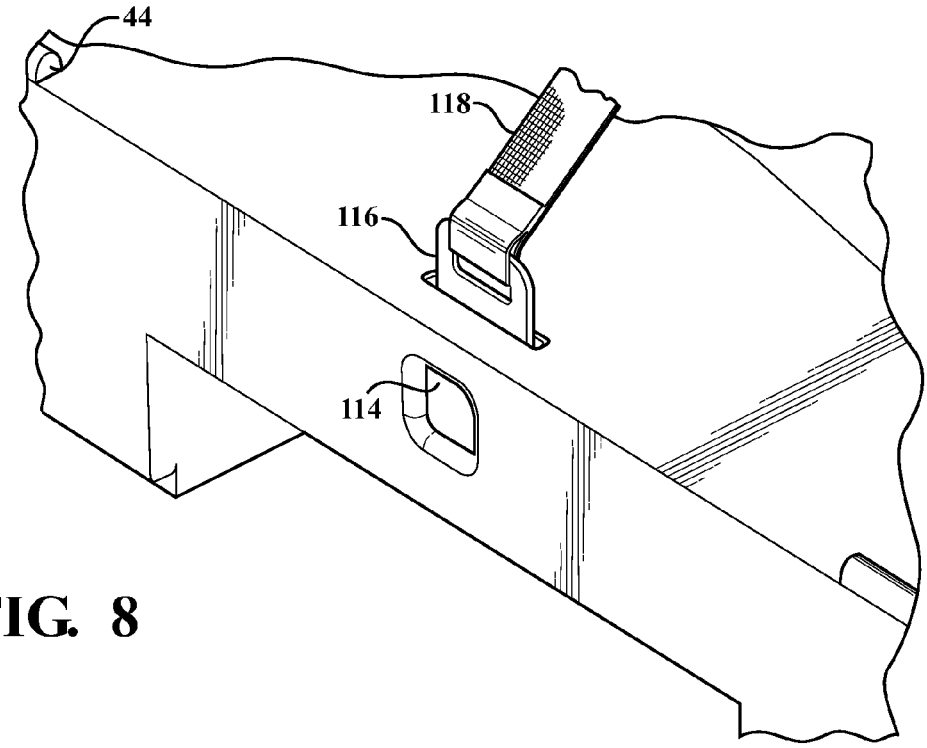
FIG. 8 is a yet further enlarged view of a button latch configured into the pallet at a further location for releasing an associated end of a strap supporting buckle.

FIG. 8 is a yet further enlarged view of a button latch 114 (see also again FIGS. 4 and 5) configured into the pallet 82 at a further location. The construction of the latch 114 is such that, upon depressing, it operates to retract a catch or other suitable linkage (not shown) from engagement with such as a notch or aperture within the body of the buckle 16 to release the buckle secured to an end of an associated strap 118.

Figure 9:
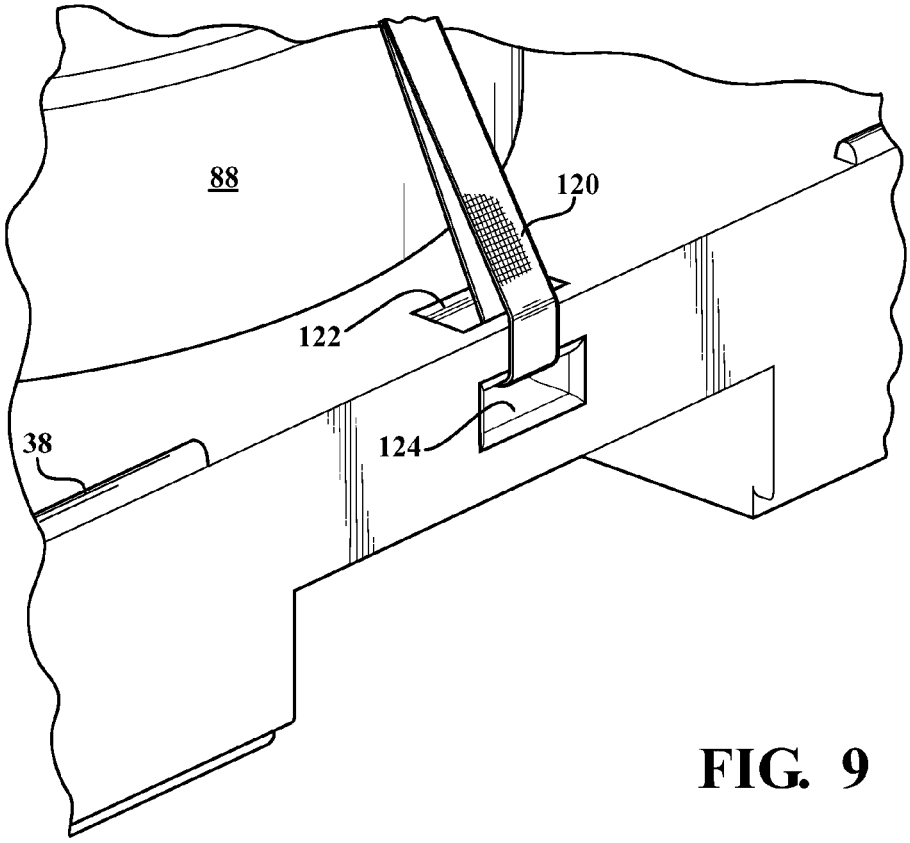
FIG. 9 is another enlarged view of a looped strap end associated with a further pallet engagement location.
Figure 10:
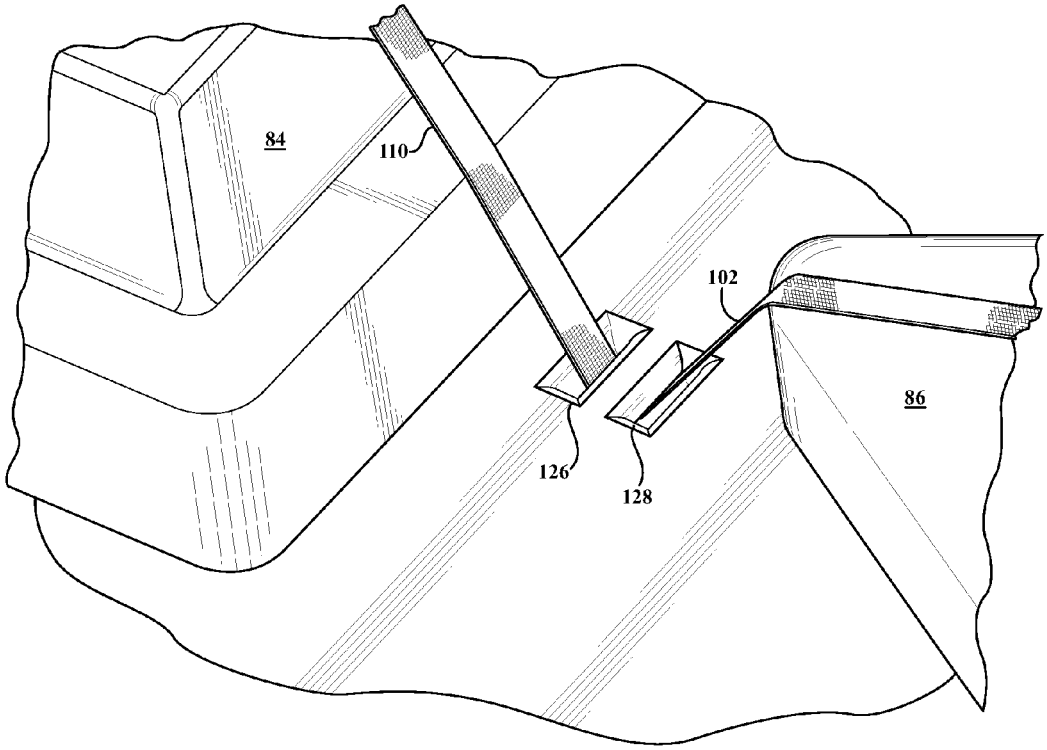
FIG. 10 is another view of an intermediate and continuous strap engagement location also illustrated in FIG. 5.

FIG. 9 is another enlarged view of a looped end of a strap 120 associated with a further pallet engagement location identified by upper 122 and side 124 communicating windows and which can be either temporarily or permanently affixed to the specified location. FIG. 10 presents another view of an intermediate and continuous strap engagement location, and which is illustrated as side by side spaced apart windows 126 and 128 exhibited upon an intermediate upper face of the pallet 82.

The strap engaging location provided by windows 126 and 128 can be isolated or, as shown, are interiorly communicated to receive a midpoint location of straps 102 and 110 (this also understood to incorporate the straps into a single extending strap between additional pallet engagement locations 100 and 112). The straps, end buckles and configuration and placement of the engaging locations upon and around the pallet is intended to provide a quick and effective means for securing either or a single or any plurality (or individual and multiple pluralities) of items upon the pallet surface in a manner which allows for secure transport. As previously described, the straps can be fixed in length, adjustable accordingly to any known structure, and/or flexible (such as without limitation in the manner of a bungee type cord).

Figure 15:
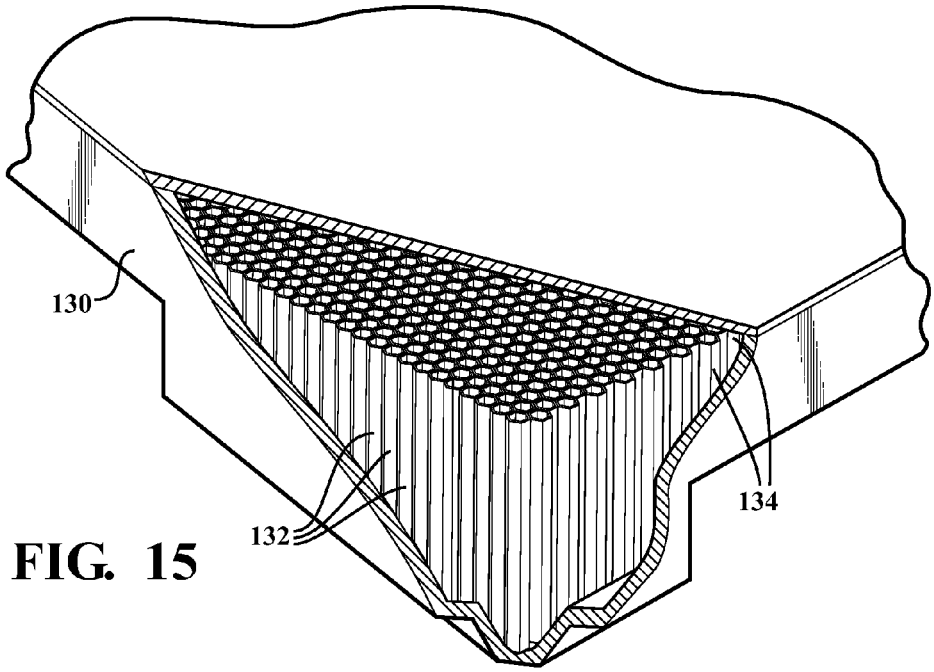
FIG. 15 is a partially cutaway and three dimensional edge location of a pallet in which the inner spine or blank is constructed of a plurality of elongated and side by side stacked honeycombed core elements constructed of any fire retardant as well as plastic or corrugated paperboard material.

Referring now to FIG. 15, a partially cutaway and three dimensional edge location is illustrated of a pallet 130 and in which the inner spine or blank is constructed of a plurality of elongated and side by side stacked honeycombed core elements 132. The elements 132 are depicted in vertically aligned fashion and, as further shown, can be provided in varying height dimension (see as further shown in cutaway by additional elements 134 of shorter height corresponding to an underside fork receiving aperture). The exterior polymeric layer is illustrated in partial cutaway and can again be either spray applied, dip-coated or injection molded according to the desired assembly process.

The multiple pluralities of elements 132 and 134 can be, without limitation, constructed of any material exhibiting fire retardant properties. The material construction of the honeycomb elements forming the pallet blank or spine can include any of plastic or corrugated paperboard material, and which are typically pre-assembled in a separate pre-assembly mold or cavity in which the individual arrayed elements (which can also include horizontally extending stacked elements in addition to the vertical arranged elements as shown) are adhesively secured (such as in the instance of a chemical adhesive applied to the surfaces of the individual paperboard or polymeric constructed honeycomb elements) or mechanically secured together (such as by heat welding of specifically polymeric or polymeric composite elements).

Figure 16:
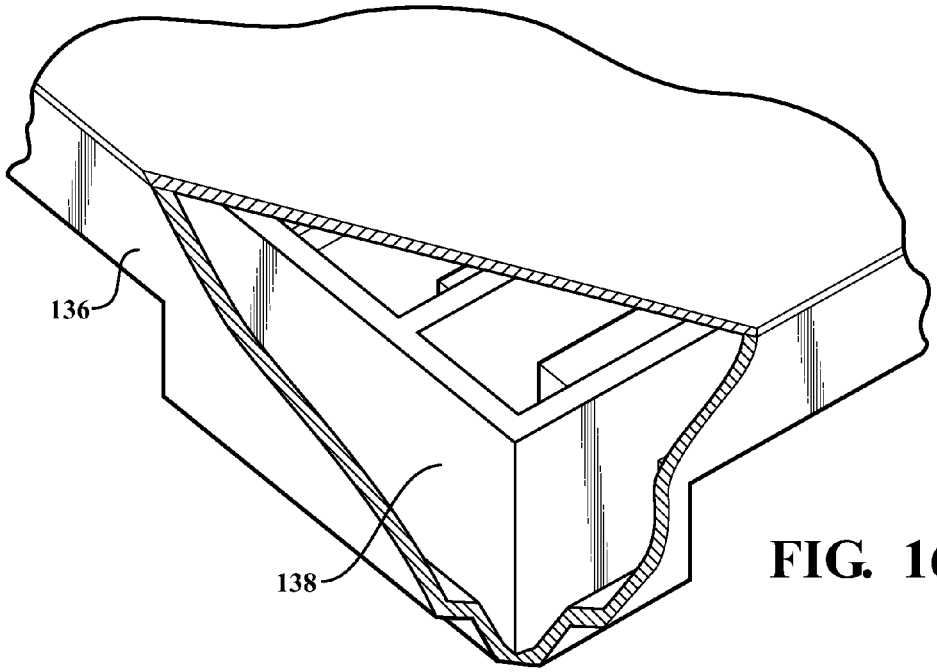
FIG. 16 is a similar illustration to that shown in FIG. 15 of a polyethylene terephthalate, commonly abbreviated PET, inner blank which is a thermoplastic polymer resin of the polyester family employed in thermoforming applications as well as other engineering resins often in combination with glass fiber.

FIG. 16 is a similar illustration of a pallet assembly, at 136, to that shown in FIG. 15 and which substitutes the individual honeycomb elements with a single formed polyethylene terephthalate, commonly abbreviated PET, inner blank 138. The PET blank as partially illustrated in cutaway exhibits a likewise honeycombed or apertured inner profile and is understood to include any of thermoplastic polymer resin of the polyester family employed in thermoforming applications, as well as other engineering resins often in combination with glass fiber or other possible aggregates/impregnates which can be mixed with the resin according to any desired proportion or ratio.

Figure 17:
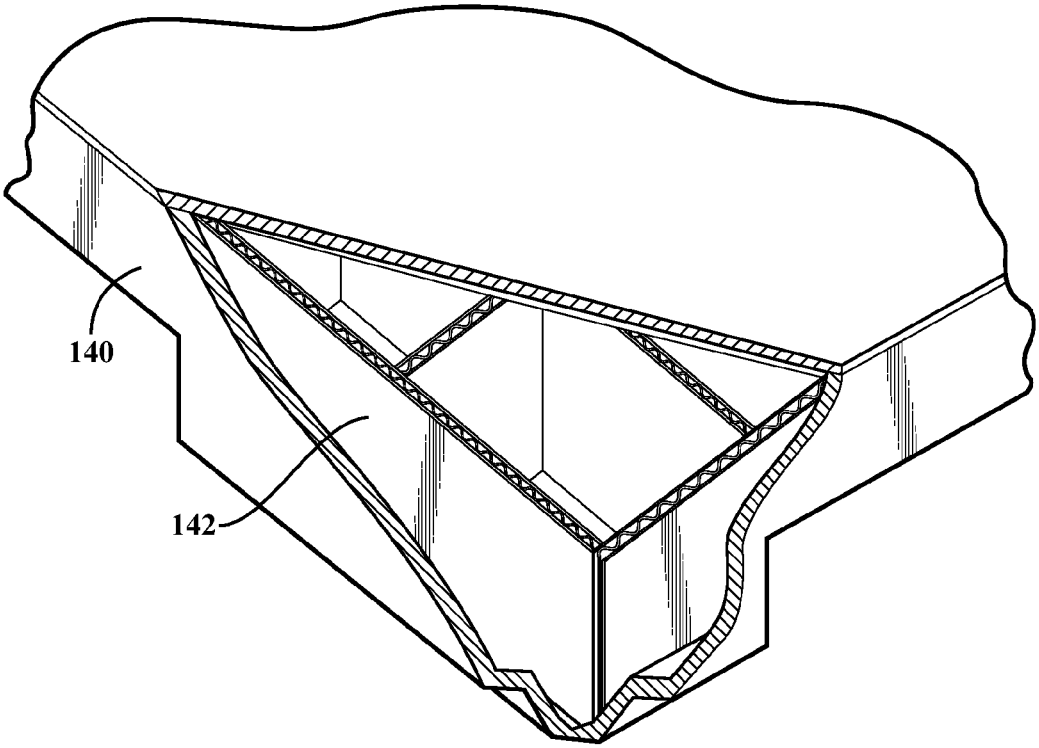
FIG. 17 is a further variant of a pallet blank construction, in comparison to either FIGS. 15 and 16, and illustrating a corrugated plastic structure.

Finally, FIG. 17 is a further variant of a pallet blank construction 140, in comparison to either FIGS. 15 and 16, and illustrating the inner blank as a corrugated plastic structure 142. In this application, the structure 142 can exhibit a blank construction similar to paperboard style corrugated (e.g. assembled with a typically three layer application of materials) albeit with the paperboard construction substituted by individual layers of plasticized material which are assembled in the manner shown.

Having described my invention, other and additional preferred embodiments will become apparent to those skilled in the art to which it pertains, and without deviating from the scope of the appended claims.

I claim:

1. A structurally reinforcing pallet, comprising:

a body having a three dimensional shape with a top, sides and bottom;

a plasticized material applied over said body according to a selected thickness and in order to encapsulate said body;

a first plurality of upper edge projecting and positional locating rim portions arranged at spaced apart locations about a periphery of said body;

a second mating plurality of recessed underside edge extending locations, enabling multiple stacking of pallets in laterally stabilized fashion in a first non-use configuration;

a load bearing and locating platen having a planar shape with an underside keyed projection, said body further including a keyed inner recess defined within said top exhibiting a mating shape which receives said underside keyed projection for seating said platen upon said body; and a plurality of clamps engaging edge locations of said platen upon mounting upon said body in a second use configuration.

2. The invention as described in claim 1, each of said platen and body being constructed of any of a durable plastic, composite polymeric or corrugated and coated material.

3. The invention as described in claim 1, further comprising said clamps arranged upon said body in encircling fashion around said keyed inner recess, said clamps mounted within individual pockets defined within said top of said body and in a surface projecting fashion such that, upon locating and seating said platen upon said body, said clamps are individually rotated such that distal extended edges associated with each clamp engages an extending edge location of said platen.

4. The invention as described in claim 1, said insert further comprising a plurality of elongated and side by side stacked honeycombed core elements.

5. The invention as described in claim 1, said insert further comprising a polyethylene terephthalate material.

6. The invention as described in claim 1, said insert further comprising a corrugated plastic structure.

7. The invention as described in claim 1, said insert further comprising an aggregate material entrained within a composite plasticized material.

8. A structurally reinforcing pallet, comprising:

a body having a three dimensional shape with a top, sides and bottom, said body including an aggregate material entrained within a composite plasticized material;

a plasticized material applied over said body according to a selected thickness and in order to encapsulate said body;

a load bearing and locating platen having a planar shape with an underside keyed projection, said body further including a keyed inner recess defined within said top exhibiting a mating shape which receives said underside keyed projection for seating said platen upon said body; and a plurality of clamps engaging edge locations of said platen upon mounting upon said body in a second use configuration.

9. The invention as described in claim 8, each of said platen and body being constructed of any of a durable plastic, composite polymeric or corrugated and coated material.

10. The invention as described in claim 9, further comprising said clamps arranged upon said body in encircling fashion around said keyed inner recess, said clamps mounted within individual pockets defined within said top of said body and in a surface projecting fashion such that, upon locating and seating said platen upon said body, said clamps are individually rotated such that distal extended edges associated with each clamp engages an extending edge location of said platen.

11. A structurally reinforcing pallet, comprising:

a body having a three dimensional shape with a top, sides and bottom, said body including any one of a group including a plurality of elongated and side by side stacked honeycombed core elements, a polyethylene terephthalate material, and a corrugated plastic structure;

a plasticized material applied over said body according to a selected thickness and in order to encapsulate said body;

a first plurality of upper edge projecting and positional locating rim portions arranged at spaced apart locations about a periphery of said body;

a second mating plurality of recessed underside edge extending locations, enabling multiple stacking of pallets in laterally stabilized fashion in a first non-use configuration;

a load bearing and locating platen having a planar shape with an underside keyed projection, said body further including a keyed inner recess defined within said top exhibiting a mating shape which receives said underside keyed projection for seating said platen upon said body; and a plurality of clamps engaging edge locations of said platen upon mounting upon said body in a second use configuration.

12. The invention as described in claim 11, further each of said platen and body being constructed of any of a durable plastic, composite polymeric or corrugated and coated material.

13. The invention as described in claim 12, further comprising said clamps arranged upon said body in encircling fashion around said keyed inner recess, said clamps mounted within individual pockets defined within said top of said body and in a surface projecting fashion such that, upon locating and seating said platen upon said body, said clamps are individually rotated such that distal extended edges associated with each clamp engages an extending edge location of said platen.

14. The invention as described in claim 1, each of said first upper projecting rim portions further comprising a bulbous projecting inner surface biasing against an opposing surface associated with a mating second recessed underside location.

* * * * *